US005326318A

United States Patent [19]

Rotter

[11] Patent Number: 5,326,318

[45] Date of Patent: Jul. 5, 1994

[54] ROOF RIDGE VENTILATOR

[76] Inventor: Martin J. Rotter, 115 Lismore Ave., Glenside, Pa. 19038

[21] Appl. No.: 110,893

[22] Filed: Aug. 24, 1993

[51] Int. Cl.[5] ..... F24F 7/02

[52] U.S. Cl. ..... 454/365; 52/199

[58] Field of Search ..... 52/57, 199; 454/364, 454/365, 367, 368

[56] References Cited

U.S. PATENT DOCUMENTS

| | | | |
|---|---|---|---|
| 1,500,368 | 7/1924 | Chupa . | |
| 2,160,642 | 5/1939 | Bumpas et al. . | |
| 2,214,183 | 9/1940 | Seymour | 454/365 |
| 3,036,508 | 5/1962 | Halvorson | 454/365 |
| 3,303,773 | 2/1967 | Smith et al. | 454/365 |
| 3,683,785 | 8/1972 | Grange | 454/365 |
| 3,942,964 | 3/1976 | Shuler | 55/494 |
| 3,949,657 | 4/1976 | Sells | 454/365 |
| 4,200,034 | 4/1980 | Listle et al. . | |
| 4,201,121 | 5/1980 | Brandenburg, Jr. . | |
| 4,325,290 | 4/1982 | Wolfert | 454/365 |
| 4,342,807 | 8/1982 | Rasen et al. | 428/180 |
| 4,484,424 | 11/1984 | Logsdon | 52/199 |
| 4,545,292 | 10/1985 | Inokawa et al. | 454/365 |
| 4,558,637 | 12/1985 | Mason | 454/365 |
| 4,642,958 | 2/1987 | Pewitt | 52/302 |
| 4,803,813 | 2/1989 | Fiterman | 52/199 |
| 4,817,506 | 4/1989 | Cashman | 454/365 |
| 4,843,953 | 7/1989 | Sells | 454/365 |
| 4,876,950 | 10/1989 | Rudeen | 454/365 |
| 4,942,699 | 7/1990 | Spinelli | 52/57 |
| 5,122,095 | 6/1992 | Wolfert | 454/365 |
| 5,167,579 | 12/1992 | Rotter | 454/365 |

FOREIGN PATENT DOCUMENTS

| | | | |
|---|---|---|---|
| 1784653 | 8/1971 | Fed. Rep. of Germany | 52/57 |

OTHER PUBLICATIONS

Drawings of Garlock-French Roofing Co. of Minneapolis, Minn., Figures 31, 32 and 37.

*Primary Examiner*—Harold Joyce

*Attorney, Agent, or Firm*—Seidel, Gonda, Lavorgna & Monaco

[57] ABSTRACT

An adjustable roof ridge ventilator for use with heavy roofing tiles. This ventilator includes a support member designed to straddle a roof ridge opening and support and space heavy roofing tiles above the roof surface. The support member has a ridge tile anchoring portion which runs along its longitudinal axis. On each side of the ridge tile anchoring portion is a side wall portion having at least one vent opening. The side walls and ridge tile anchoring portion form an open channel. An air-permeable vent material is disposed in and along the channel. The lower portion of each side wall is formed outward to form a skirt portion for straddling the roof ridge. Each side wall portion may have a plurality of parallel crease lines therein allowing for the support member's height to be adjusted by forming the skirt portion at a selected crease lines.

17 Claims, 6 Drawing Sheets

ROOF RIDGE VENTILATOR

FIELD OF THE INVENTION

This invention is related to the general field of attic and roof ventilation systems. It is particularly related to roof ridge ventilators for tile roofs.

BACKGROUND OF THE INVENTION

It has been a long known practice to ventilate attics under gable roofs by running a vent along the roof ridge. Such vents are created by an open slot running along the roof ridge, essentially the length of the roof, which causes ventilation out of the attic by convection airflow and by suction from wind blowing across the roof.

A soffit ventilation system is frequently used in conjunction with a ridge vent to provide passive ventilation. The soffit vents allow fresh ambient air to flow into the attic to equalize attic temperature and pressure with the outside. As stale hot air is withdrawn from the ridge slot vent by convection and/or wind suction, it is replaced by fresh ambient air enters the attic through the soffit vents.

Differences between the various types of ridge vents are often found in the capping structures used over the vent slot to exclude water and pests. A description of representative types of ridge vents and capping structures, and attributes or problems associated with various types, is found in a prior patent of this inventor, U.S. Pat. No. 5,167,579 (Rotter). That patent discloses, as a solution to many of the problems associated with prior ridge vents, an improved roof ridge venting system using a unitary mat constructed of randomly-aligned synthetic fibers which are joined by phenolic or latex binding agents and heat cured to provide an air-permeable mat with a varying mesh. Cap shingles are supported by the mat and are nailed directly to the roof through the mat. In contrast to other vent materials, the unique features of the mat disclosed in the Rotter patent result in many desirable physical properties such as high tensile strength, high resiliency, the ability to be transported in rolls and cut to length, ease of joining strips, durability in local ambient conditions, and an excellent water and insect barrier. Moreover, it provides the aforementioned desirable features in a thin sheet to permit the vent structure to maintain a low profile along the roof.

Although the vent disclosed in the Rotter patent has desirable applications in many roof types, some of its advantages begin to diminish when it is used in conjunction with heavy roofing tiles. As used herein, the phrase "heavy roofing tiles" refers to tiles made from materials which include, but are not limited to, slate, terra cotta, concrete, and clay. These tiles are distinguished by their bulk and weight, as contrasted to the relatively lighter shingles made of asphalt, wood, fiberglass, polymers and the like.

A vent structure useable with such heavy roofing tiles should not only retain its desirable features set out above, it must be able to support and anchor the capping elements, which are frequently heavy ridge tiles of same or similar shape and construction as the roof tiles, and must retain them in position even in high wind and other adverse environmental conditions such as temperature extremes and the accumulation of heavy layers of snow or ice. A recently developed reinforced vent matting for this purpose is disclosed in PCT published application number US92/06658 (also Rotter). In one embodiment of the Rotter PCT application, the unitary matting of randomly-aligned synthetic fibers includes a grid pattern of small reinforcing pins extending perpendicularly through the thickness of the mat. These reinforcing pins are designed to support heavy roof ridge tiles without significantly hampering airflow through the vent matting.

Notwithstanding the availability of using the pin-reinforced vent matting disclosed in the Rotter PCT application in a ridge vent for heavy roofing tiles, this invention is directed to a novel roof ridge ventilation system which is designed to support and anchor heavy ridge tiles, and to the method of venting such tiled roofs with this novel system. In particular, it is designed for typical terra cotta tile roofs, wherein the tiles have a nearly semi-circular section profile, and are laid in rows alternatingly inverted and overlapped with the preceding row to form an undulating sequence of crests and gutters. The same or similar shaped tiles are then laid along the ridge to cap the slot and to impart a rounded appearance to the ridge.

In prior construction using only basic building materials, a wood beam or "ridge pole" was installed in the slot to anchor and support the capping tiles, which were nailed to the top edge of the beam. In some instances guide rods were used where the nails were not sufficient to anchor the capping tiles, as shown in U.S. Pat. No. 2,214,183 (Seymour). Strips of sheet metal were sometimes bent at an angle and tacked to the sheeting adjacent the slot on each side to extend under the cap and act as a baffle deflector of wind-driven rain and debris, or specially constructed shingles could be used for the same effect (see element 6 in Seymour). To inhibit pests, a screen may have been laid across the slot under the ridge pole, or draped over the ridge pole and tacked to the sheathing, or contoured under the capping tile (see element 16 in Seymour).

One attempt to provide an improved structure for supporting such capping tiles is disclosed in U.S. Pat. No. 4,558,637 (Mason). The apparatus disclosed in Mason uses a support member with a center anchoring crest for nailing the tiles thereto and longitudinal upright side portions to support edges of the tiles. Vent openings in the side portions and in the shield portions connect the sides to the crest.

None of the above described devices includes an air-permeable vent material, nor appears to be readily adjustable in height, nor is assembled from easily handled components.

One objective, therefore, is to provide a roof ridge ventilator which is designed for use with heavy roofing tiles and which includes an air-permeable vent material as a water and insect barrier. Another object is to provide the capability to adjust the height of this roof ridge ventilator to accommodate various shapes and heights of tile. A further object is to provide components of the ventilating system in convenient and easy to handle forms such as rolls and sheets, and to provide a convenient method of assembling and installing the ventilation system on roofs of different lengths and slope. These and other objects are achieved through the novel roof ridge ventilation system described below.

SUMMARY OF THE INVENTION

This invention is directed to a ventilation system and ventilator structure for use in ventilating a building having a sloped roof with an open slot disposed longitudinally along its ridge. The ventilator system is adapted to permit ventilating air from interior space under the roof to flow through the slot to the exterior and to support and secure one or more cap elements over the slot. This system includes a novel ventilator structure designed to straddle the ridge slot and support the heavy roofing tiles above the roof surface. An air-permeable material contained within the structure permits ventilating air flow while providing a barrier to water, dirt and insects.

The ventilator structure includes a metal elongated support member adapted to straddle the slot such that its longitudinal axis is substantially aligned over the longitudinal axis of the slot. The support member is shaped essentially as a hollow rectangular-section beam with the bottom of the beam open and skirt sections flared therefrom at the slope angle of the roof. That is, the shape of the support member is such that it includes: (a) a cap element anchoring and support portion running along the top of the hollow beam, (b) two longitudinally-oriented side walls, each wall connected to and depending vertically downward from the support portion, and (c) two longitudinally-oriented skirt portions, each skirt portion depending from one of the side walls at an angle generally conforming to the slope of the roof. By this shape, the side walls and cap element support portion define a longitudinally oriented channel between the side walls. An air-permeable venting material is contained in and fills the channel. The side walls each have at least one vent opening, preferably formed by at least one outwardly extending flap. The upper edge of each side wall is connected to the anchoring portion. Thus, the ventilating air must pass from the roof slot through the venting material and out of the vent openings. At the same time, the vent material blocks moisture, dust, dirt, insects and the like form passing into the slot from the exterior.

The vent material may be secured in the channel by metal screws passing from one side wall through the vent material and out the other side wall, such that tightening the screws draws the side walls toward each other to compress the vent material. In a preferred embodiment, the vent material is a strip of synthetic non-woven matting which includes reinforcing pins extending though the strip. In this embodiment, the screws draw the opposing side walls toward each other until further travel is inhibited by the pins, thus increasing the stiffness and lateral strength of the support member.

This invention also provides a means for adjusting the height of the ventilator structure. Each side wall portion may have a plurality of parallel longitudinal grooves therein at spaced intervals which serve as crease lines. In this embodiment, the desired height of the support structure is determined and the side wall is bent outward to form the skirt portions along the particular crease line which most closely corresponds to the desired height.

In one embodiment, the elongated support member is manufactured, and may be delivered to the job site, as a flat metal sheet. The sheet has pre-formed depression grooves stamped or scored thereon to define the crease lines along which the sheet can be folded to create the support member, at the selected height. Additional crease lines and perforations in the sheet define flaps which are pushed outward to create the vent openings in the side walls and which remain as baffles protecting the openings from wind-driven water or debris.

This invention includes the method of forming and installing the novel ventilator system described above.

Other objects, aspects and advantages of the present invention will be apparent to those skilled in the art upon reading the specification, drawings, and claims which follow.

BRIEF DESCRIPTION OF THE DRAWINGS

For the purpose of illustrating the invention, the drawings are of forms which are presently preferred. However, the invention is not limited to the precise arrangements and instrumentalities shown.

DETAILED DESCRIPTION OF THE INVENTION

Figure 1:
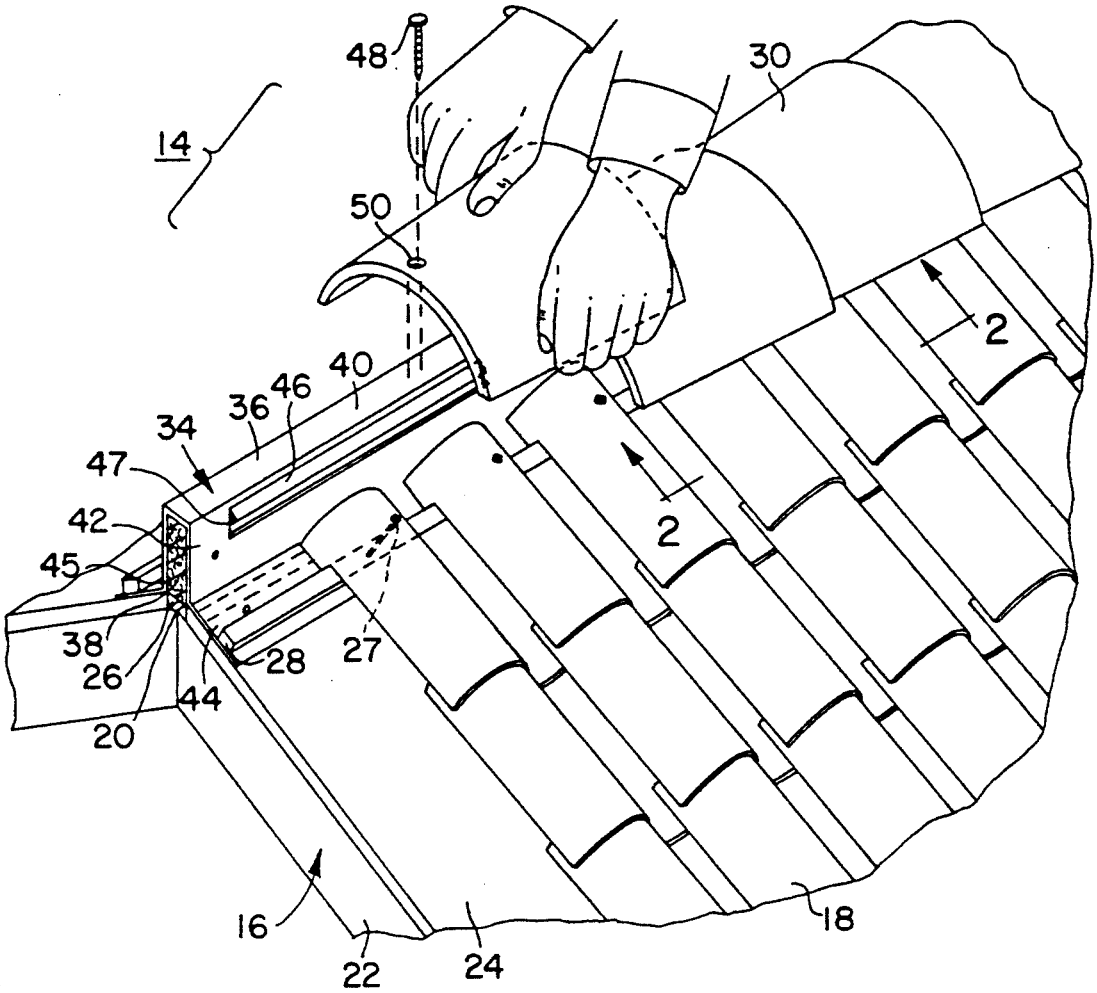
FIG. 1 is a perspective view of a portion of a roof ridge showing a preferred embodiment of the roof ridge ventilator of the present invention installed thereon.

In the drawings, like numerals indicate like elements and primes (') indicate counterparts of such like elements.

FIG. 1 illustrates one embodiment of a roof venting system, designated generally as 14, in accordance with the present invention. The roof venting system is described in relation to a sloped roof 16 covered with a plurality of generally semicircular-section terra cotta tiles 18. However, the same or substantially similar roof ventilation system can be adapted for an used with other roof coverings.

The roof comes to a ridge 20 at a slope defined by its rafters 22. An upper row of sheathing panels 24 fastened onto the rafters terminate approximately ¾ to 1 inch short of the crest of the ridge, therein defining an open vent slot 26.

Figure 2:
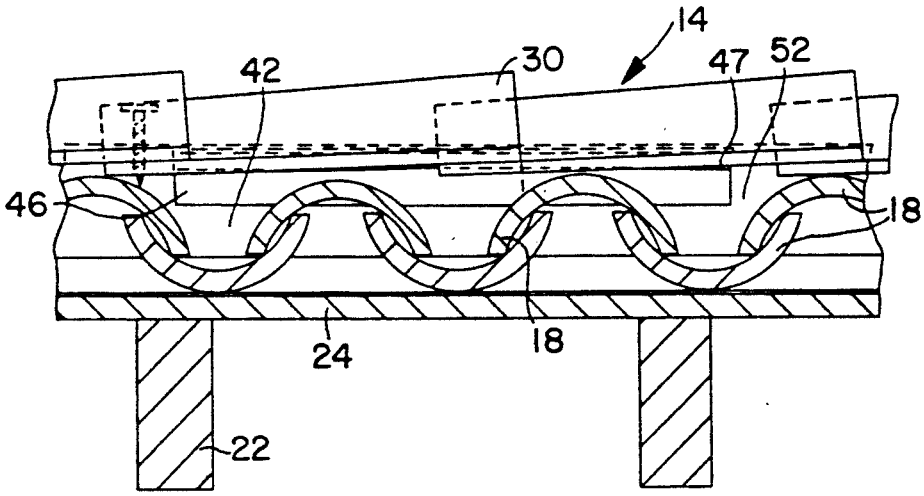
FIG. 2 is a cross-sectional view of the roof ridge ventilator illustrated in FIG. 1 and taken along line 2—2.

In typical terra cotta tile roof construction, the terra cotta tiles 18 are laid on the roof in rows beginning at the cornice or eaves (not depicted) of the overhanging roof 16. The next row of tiles is laid higher up the roof, with a portion of each tile overlaying the corresponding tile in the previously laid row. This popular style of terra cotta tiles have the familiar "half-moon" or nearly semi-circular section profile, as shown in the drawings, and are laid alternatingly inverted and overlapped with the preceding row to form an undulating sequence of crests and gutters as shown in FIGS. 1 and 2. Rows of tiles are laid in this manner until a top row is laid and secured by nails 27 to an upper row batten 28.

In prior construction, a plurality of ridge tiles 30 are thereafter installed as capping elements along a wooden ridge beam or other structure, as described in the background section of this specification, to cover the slot and to extend over the top row of tiles on both sides to deflect rain down the slope of the roof.

The effectiveness of the ridge vent depends upon the degree to which convection outflow and wind across the vent line is uninhibited by the vent structure. Most effective would be a completely uncovered slot, but the need to keep out rain water, dirt and pests requires some sort of covering structure such as the ridge tiles described above. Design consideration for a vent structure is, therefore, to maximize convection and suction outflow, and establish an effective barrier against water, dirt and insect entry, maintaining aesthetic appearance and long term durability while providing low cost construction and ease of installation.

The roof ventilation system disclosed herein is especially useful to meet these design considerations on a roof which is covered by heavy roofing tiles, such as the depicted terra cotta tiles 18. The system includes a new ventilator structure 34 comprised of an elongated support member 36 and an air-permeable venting material 38. The elongated support member 36 essentially replaces the wooden ridge pole of the prior construction, while providing significant advantages in venting, water and insect barrier, height adjustment, and ease of handling and installation.

The support member 36 is formed to support and anchor the cap elements. Since terra cotta tiles are used as the capping elements in this construction, the support member 36 is formed to define a ridge tile anchoring portion 40, a pair of longitudinally oriented side wall portions 42, and a pair of longitudinally oriented skirt portions 44. The ridge tile anchoring portion 40 and the side wall portions 42 thereby circumscribe an elongated rectangular channel 45. Thus, the support member is shaped essentially as a hollow rectangular-section beam, with the bottom of the beam open and with skirt sections flared therefrom at the pitch angle of the roof.

A strip of air-permeable venting material 38 is located in and fills the channel 45 between and in contact with the two longitudinally oriented side walls 42 and the ridge tile anchoring portion 40. Although other air-permeable mesh materials could be used, the preferred venting material 38 is a strip of non-woven synthetic fiber matting, as described in U.S. Pat. No. 5,167,579 (Rotter), which is incorporated by references and which further defines the properties of the preferred material.

Each side wall 42 of the support member includes one or more pairs of flaps 46, each pair defining a vent opening 47 in the support member 36. Thus, ventilating air may flow up through the slot, through the air-permeable material, and exit the support member at the vent openings.

The skirt portions 44 conform to the slope of the roof and are secured to the upper row sheathing panels 24 by roofing nails driven through the skirt portions. The ridge tiles 30 are secured to the tile anchoring portion 42 by screws 48 which extend through pre-drilled holes 50 in the tile.

As shown in the side cross-sectional view of FIG. 2, the edges of the ridge tiles 30 may contact the crests of the upwardly-curved roof tiles 18. As described below, the height of the support member may be selected to cause the tiles to contact in this manner. Between the crests are large openings 52 through which air may flow. These large openings may allow wind driven rain, snow or dirt to blow under the ridge tiles, or pests to enter under the ridge tiles, but the flaps 46 act as baffles against rain, snow or dirt, and the air-permeable material 36 prevents foreign matter and pests from entering the building through the ridge slot 26.

Figure 3:
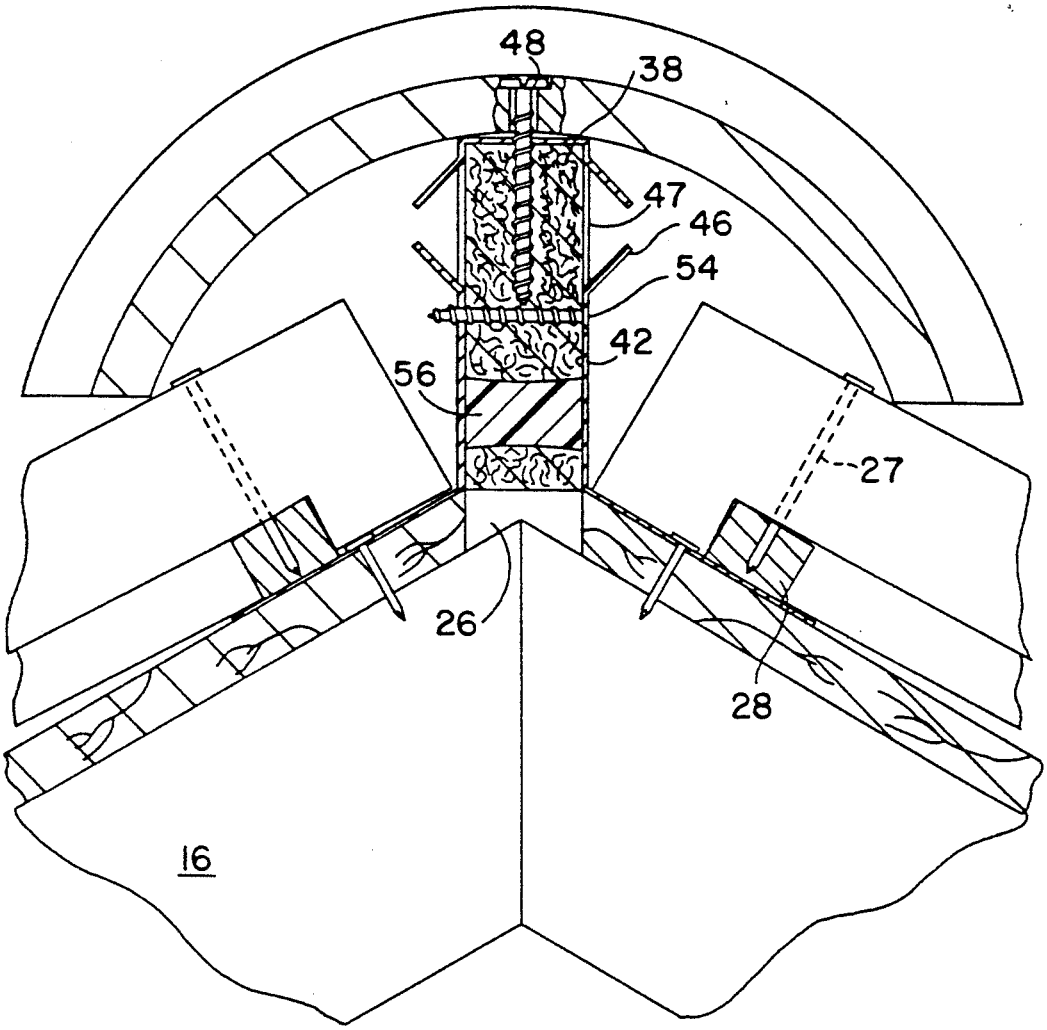
FIG. 3 is a cross-sectional view of a portion of a roof ridge showing a preferred embodiment of the roof ridge ventilator of the present invention installed thereon.

FIG. 3 shows a front cross-sectional view of the roof ridge 20 and ventilation system. The air-permeable venting material 38 fills the channel between the side walls 42. A metal screw 54 passes from one side wall through the venting material 38 and out through the other side wall to pull the side wall portions against the venting material, and thereby increase the rigidity of the support member.

In a preferred embodiment, plastic reinforcing pins injected as a quick-set resin into the venting material act as spacers 56 which limit the inward movement of the side wall portions 42 as the screws are tightened, keeping the walls from flexing and creating a uniform, rigid, beam-like structure. Patent Cooperative Treaty Application No. US92/0665A discloses an air-permeable venting mat including a grid pattern of such small reinforced pins extending perpendicular through the thickness of the mat, and such teaching is incorporated herein by reference. However, it should be apparent that other types of suitable pin or equivalent spacer may be inserted through the vent material to limit inward movement of the side wall portions.

Figure 4:
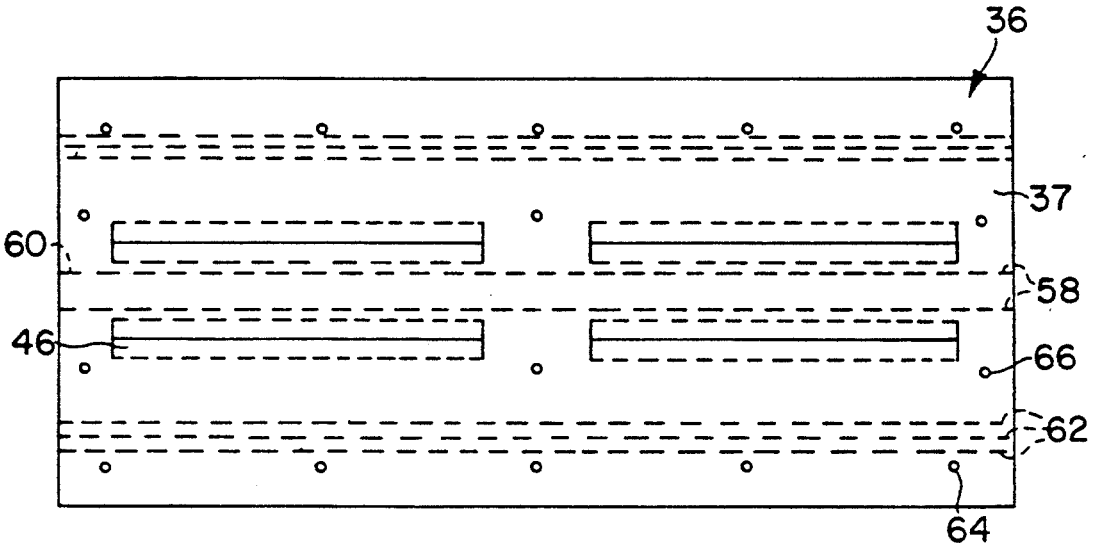
FIG. 4 is an overhead view of a flat sheet of a material with stamping thereon to form a support member embodiment as illustrated in FIG. 3.
Figure 5:
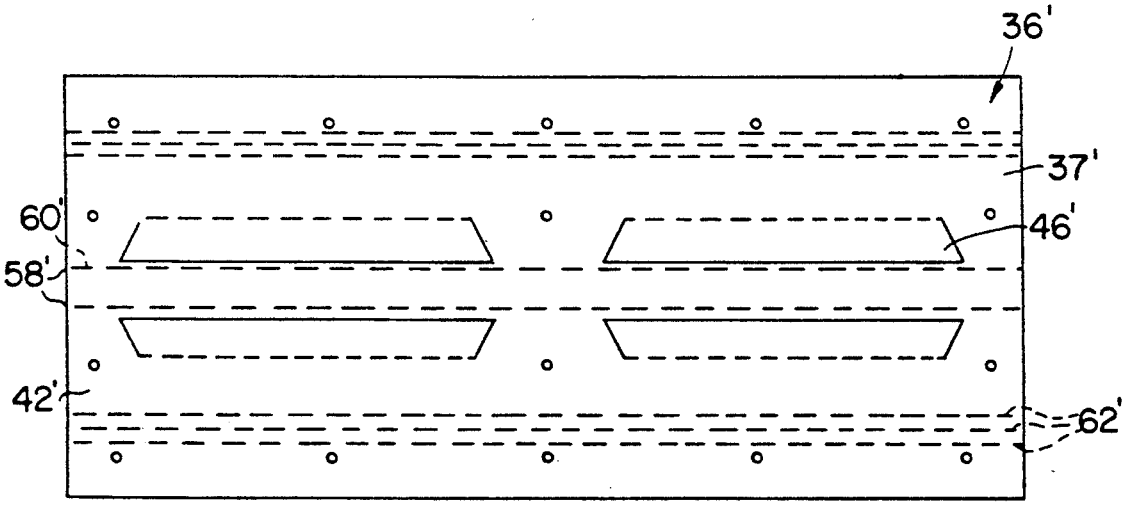
FIG. 5 is an overhead view of a flat sheet of a material with stamping thereon to form the support member of another embodiment.

The elongated support member 36 is manufactured, and may be delivered to the job site, as a generally rectangular flat sheet 37 as shown in FIGS. 4 and 5. The preferred sheet material is eighteen gauge aluminum in a width of thirty-six inches and lengths of four, eight or twelve feet, but other metals, materials and dimensions may be feasible alternatives. The sheet 37 has stamped or scored grooves and/or perforations to facilitate its being folded into the support member. A pair of preformed depression grooves 58 are stamped on either side of and parallel to its long axis, along which the lateral sides of the sheet can be folded 90° to create the ridge tile anchoring portion 40. The grooves then become the upper side edges 60 of the longitudinally oriented side wall portions 42. In addition, each lateral side of the sheet 37 has a set of three or more parallel depression grooves 62 spaced ½ inch apart to serve as crease lines, wherein the desired height of the side wall portions 42 can be chosen in half-inch increments according to the chosen pair of crease lines. The sheet 37 is bent along the chosen crease line 62 to match the pitch of the roof 16, therein defining the skirt portions 44.

The sheet 37 has perforated score lines and depression grooves which define and allow the bending outward of flaps 46 to create vent openings 47. The sheet 37 may also have a plurality of holes 64 outboard of the side crease lines for nailing the skirt portion 44 to the upper row of sheathing panel 24 as previously shown in FIG. 3. Additional holes 66 may optionally be located in the side wall portions between the vent openings for aligning the screws 54 between the two side wall portions 42.

FIG. 5 shows an alternative flattened sheet 37' wherein the vent opening 46' is created by bending out a single flap. Similar to the sheet 37 of FIG. 4, the sheet 37' of FIG. 5 has a pair of preformed depression grooves 58' for defining the side edges 60' of the ridge tile anchoring position 40'. Likewise the sheet 37' has a plurality of side depressions 62', wherein the desired side depression is chosen and creased and bent to match the pitch of the roof 16 and the desired height of side wall portions 42' of the support member 36'.

Figure 6:
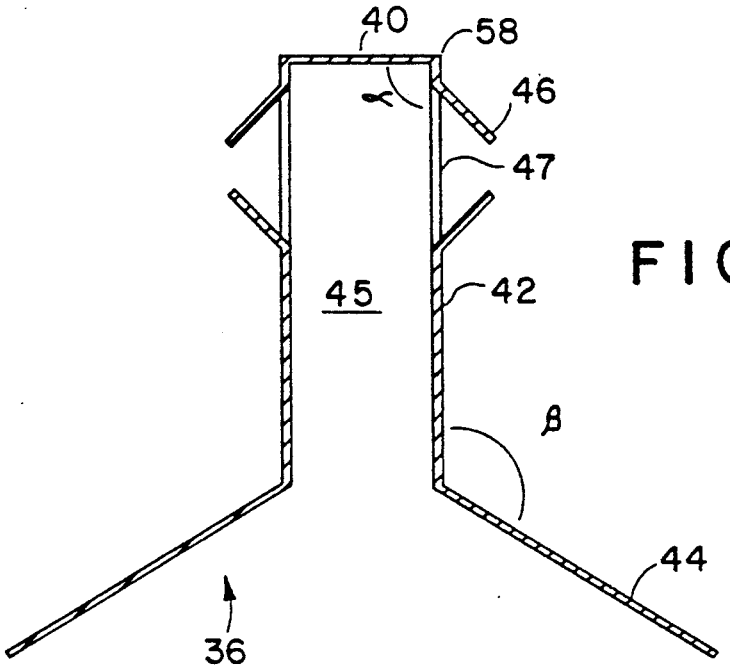
FIG. 6 is a cross-sectional view of the support member embodiment illustrated in FIGS. 3 and 4.

FIG. 6 shows the sheet 37 of FIG. 4, folded as described above 4 into an elongated support member 36, with the pair of preformed depression grooves 58 creased and bent to define the side edges of the upper ridge tile anchoring edge portion 40. The depression groove 58 is typically bent to form an angle $\alpha$ of 90° between the tile anchoring portion 40 and the side wall portion 42. The desired height for the side wall portions 42 of the support member have been determined and the proper side creases 62 has been bent such that the skirt portion 44 is at a proper angle to the side wall portion 42. The skirt portion 44 matches the pitch of the roof 16. Typically the skirt is bent at an angle $\beta$ of between 120° and 150° relative to the side wall portion 42. The flaps 46 are pushed slightly outward to create the opening 47 as shown, but still act as a baffle against wind driven water, snow and debris. FIG. 6 also more clearly illustrates the channel 45 which receives the venting material 38.

Figure 7:
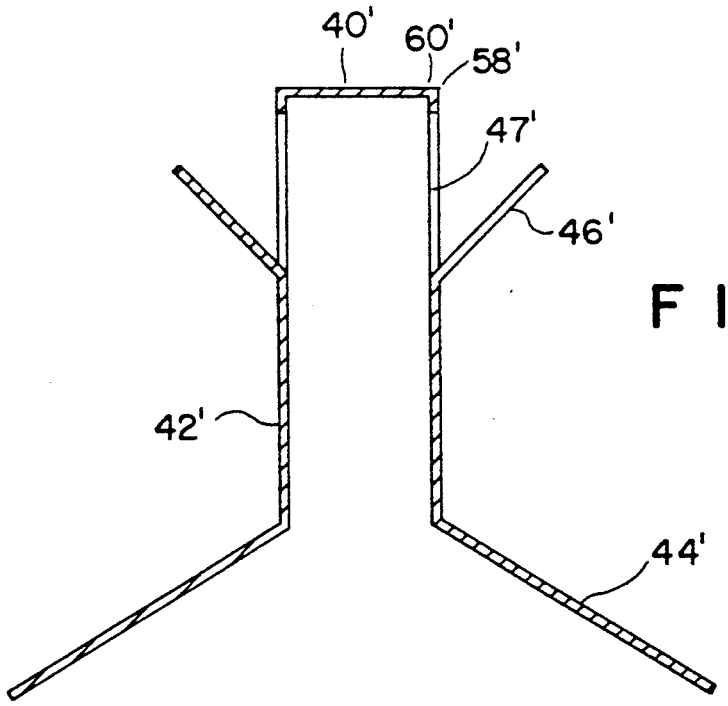
FIG. 7 is a cross-sectional view of another embodiment of the support member illustrated in FIG. 5 which can be used when practicing the present invention.

FIG. 7 shows the alternate embodiment made from folding the metal sheet depicted in FIG. 5, wherein the elongated support member 36' has a single flap 46'.

Figure 8:
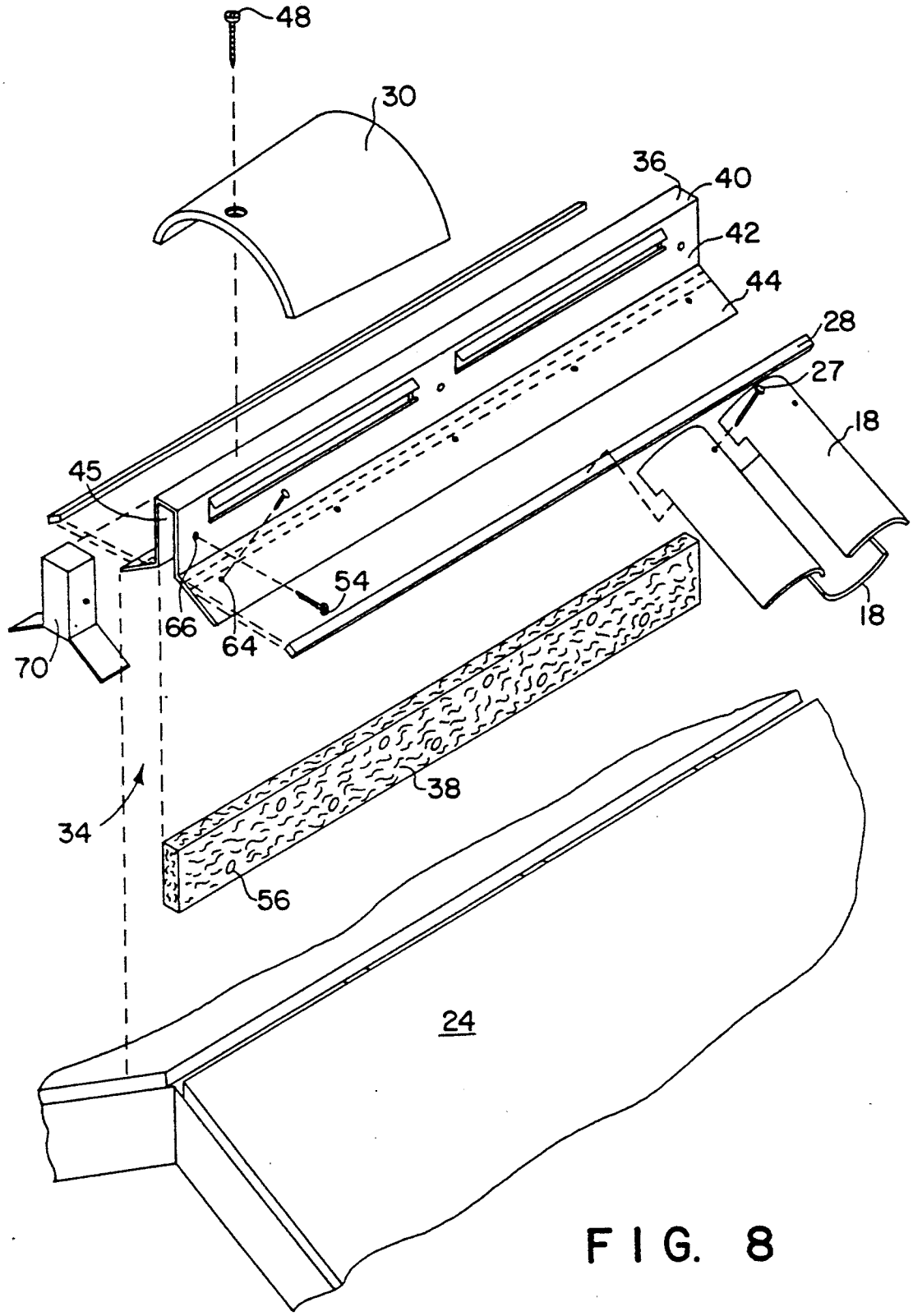
FIG. 8 is an exploded perspective view of a roof ridge ventilator prepared in accordance with one embodiment of the present invention, wherein the venting material includes reinforcing pins.

Referring to FIG. 8, after the elongated support member 36 has been bent to the proper shape, therein defining the height of the side wall portion 42 and roughly defining the angle of the skirt 44 necessary to conform to the slope of the roof, a strip of air-permeable venting material 38 is inserted into the channel 45 between the side wall portions 42. Metal screws 54 are threaded through the holes 66 in one side wall portion, through the air-permeable venting material, and out the corresponding holes in the opposite side wall. The screws are tightened until the spacers 56 of the air-permeable venting material 38 inhibit further movement. The fasteners 54 keep the side wall portions 42 from flexing and therefore maintain rigidity of the structure under the weight of the tiles and environmental stresses.

The elongated support member 36 and the air-permeable venting material 38, now assembled as described above into the completed ventilator structure 34, is placed on the roof 16, straddling the slot with the skirt portions 44 engaging the upper row sheathing panel 24. Final adjustment bending of the skirt portions may be made at the crease lines to conform to the slope of the roof, and the ventilator is thereafter secured to the roof by nails driven through holes 64 into the upper row sheathing panel 24. An end cap 70 is placed at the end of the elongated support member 36. The upper row of terra cotta tiles 18 on each side is laid and secured to the roof 16 by the batten 28 and nails 27. The final step is to install the ridge tiles 30 by screws 48 through the predrilled holes 50 in the tiles. The screws tap through the ridge tile anchoring portion 40 of the elongated support member 36 into the air-permeable venting material 38.

Figure 9:
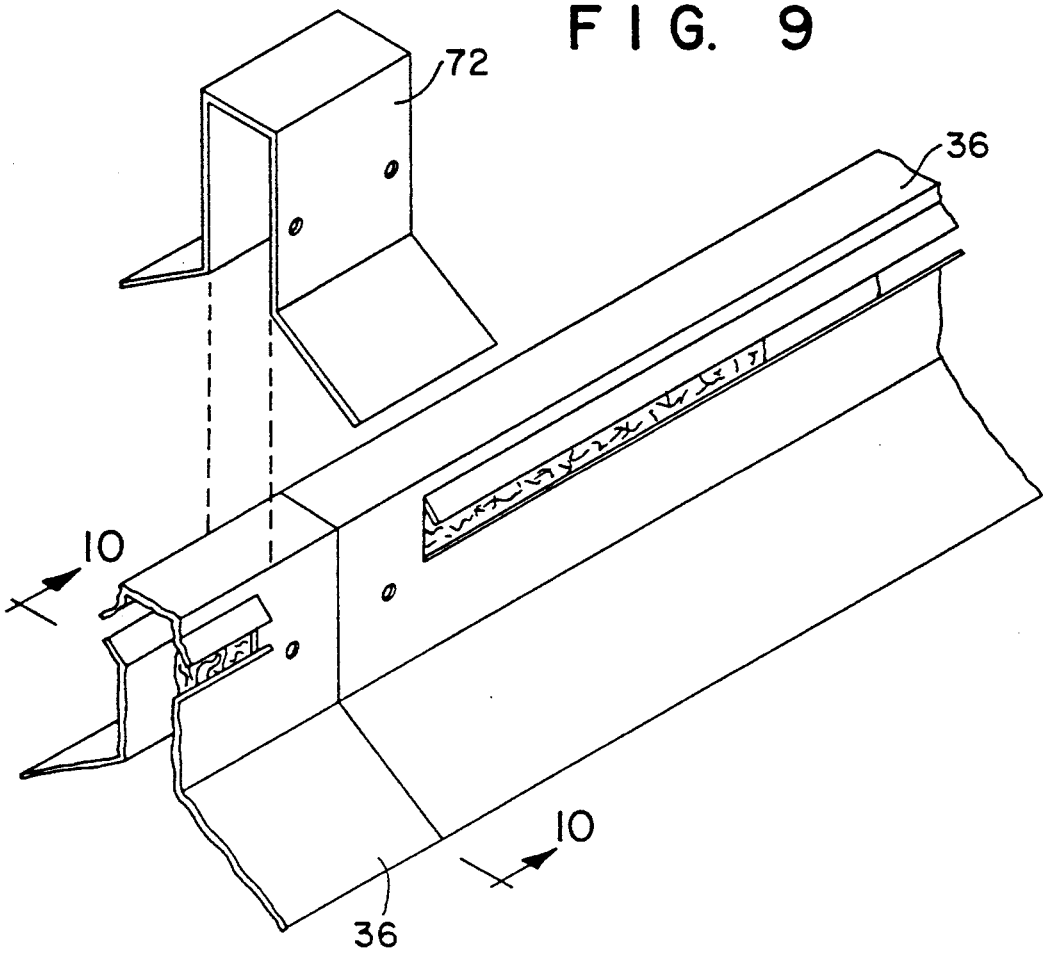
FIG. 9 is a perspective view of two roof ridge ventilator portions joined end-to-end in accordance with the present invention.
Figure 10:
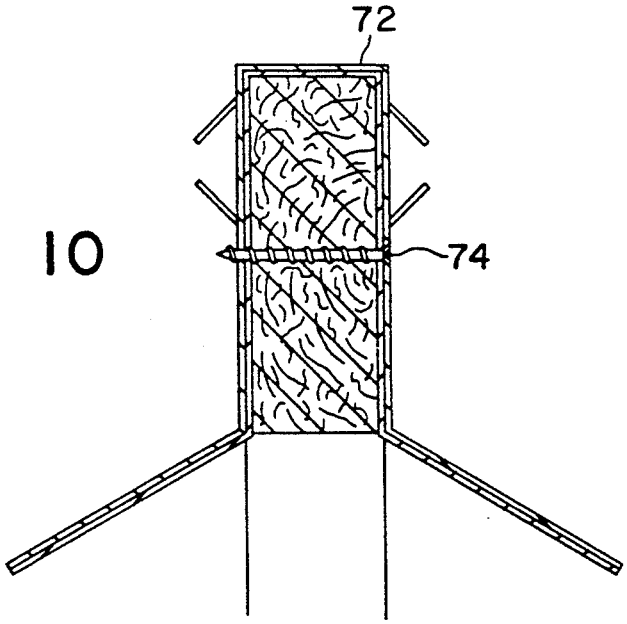
FIG. 10 is a cross-sectional view of a roof ridge ventilator and a connecting saddle taken along line 10—10 of FIG. 9.

The elongated support members 36 may be mass produced from aluminum sheets in finite manageable length segments, such as eight or twelve foot lengths. More than one elongated support member may be is required to cover the slot on any particular roof ridge. Referring to FIGS. 9 and 10, two elongated support member segments 36 may be joined by a splice cap 72 which overlay the abutting ends of the support members 36 and is secured to them by a pair of screws 74.

It is evident from the foregoing that various modifications, which are apparent to those skilled in the art, can be made to the embodiments of this invention without departing from the spirit or scope thereof. For example, and not intending to list all of the possible modifications, it is apparent that the different fasteners or adhesives may be substituted for each other where appropriate, such as rivets for screws, etc., and that different spacings of score and crease lines may be employed, and that different materials may be used to accomplish the same or equivalent effect as the structures described in the preferred embodiments. Consequently, one seeking to determine the scope of the invention should refer first to the claims located at the end of this specification.

That which is claimed is:

1. A roof ridge ventilation system for ventilating a building having a sloped roof, which includes an open slot disposed along the roof ridge, a ventilator structure adapted to permit air from interior space under the roof to flow through the slot to the exterior, and at least one cap element supported and secured over said slot; wherein the ventilator structure of the system comprises:

(a) an elongated support member adapted to straddle the slot such that the support member is substantially aligned with and over the slot, said support member including:

(i) a cap element support portion running along the longitudinal axis of said support member, (ii) two longitudinally-oriented side walls, each wall connected to and depending vertically downward from the support portion to define a channel therewith each said side wall having at least one vent opening therethrough, and (iii) two longitudinally-oriented skirt portions, each skirt portion connected to and depending from one of the side walls at an angle generally conforming to the slope of the roof, (b) air-permeable vent material positioned in and along said channel, substantially filling the channel between the side walls.

2. A roof ridge ventilation system as recited in claim 1, wherein said elongated support member has a plurality of parallel longitudinal grooves adapted as crease lines to define each skirt portions from its adjacent side wall, whereby the height of the side walls may be selected by bending the support member along chosen crease lines.

3. A roof ridge ventilation system as recited in claims 1 or 2, wherein a vent opening in a side wall is formed with a flap disposed outwardly and upwardly from the bottom of the opening.

4. A roof ridge ventilation system as recited in claim 1 or 2, wherein a vent opening in a side wall is formed with two flaps, one disposed outwardly and upwardly from the bottom of the opening and the other disposed outwardly and downwardly from the top of the opening.

5. A roof ridge ventilation system as recited in claims 1 or 2, wherein said air-permeable vent material includes a plurality of horizontally oriented reinforcing pins, wherein the material is positioned in and along said channel such that the longitudinal axis of the reinforcing pins is generally perpendicular to the longitudinal axis of said support member.

6. A roof ridge ventilation system as recited in claim 5, wherein said vent material is anchored to said support member side walls by at least one horizontally oriented fastener passing through the side walls and vent material and securing said side walls against the vent material.

7. A ridge ventilator for location along a roof ridge which defines at least one slot opening at the ridge for the passage of air through the roof surface, said ventilator comprising:

(a) an elongated support member adapted to be located longitudinally over and straddling the slot along the ridge, said support member including:
  (i) a cap element support portion running along the longitudinal axis of said support member,
  (ii) two longitudinally-oriented side walls, each wall connected to and depending vertically downward from the support portion, each said side wall having at least one vent opening therethrough, and
  (iii) two longitudinally-oriented skirt portions, each skirt portion connected to and depending from one of the side walls at an angle generally conforming to the slope of the roof,
  (iv) wherein the side walls and cap element support portion to define a longitudinally oriented channel between the side walls; and
(b) air-permeable vent material positioned in and along said channel, substantially filling the channel between the side walls.

8. A ridge ventilator as recited in claim 7, wherein said elongated support member has a plurality of parallel longitudinal grooves adapted as crease lines to define each skirt portions from its adjacent side wall, whereby the height of the side walls may be selected by bending the support member along chosen crease lines.

9. A ridge ventilator as recited in claims 7 or 8, wherein a vent opening in a side wall is formed with a flap disposed outwardly and upwardly from the bottom of the opening.

10. A ridge ventilator as recited in claim 7 or 8, wherein a vent opening in a side wall is formed with two flaps, one disposed outwardly and upwardly from the bottom of the opening and the other disposed outwardly and downwardly from the top of the opening.

11. A ridge ventilator as recited in claims 7 or 8, wherein said air-permeable vent material includes a plurality of horizontally oriented reinforcing pins, wherein the material is positioned in and along said channel such that the longitudinal axis of the reinforcing pins is generally perpendicular to the longitudinal axis of said support member.

12. A ridge ventilator as recited in claim 11, wherein said vent material is anchored to said support member side walls by at least one horizontally oriented fastener passing through the side walls and vent material and securing said side walls against the vent material.

13. An elongated support member for straddling the vent slot of a roof ridge venting system and supporting capping elements over the slot, comprising:

(i) a cap element support portion running along the longitudinal axis of said support member,
(ii) two longitudinally-oriented side walls, each wall connected to and depending vertically downward from the support portion, each said side wall having at least one vent opening therethrough, and
(iii) two longitudinally-oriented skin portions, each skin portion connected to and depending from one of the side walls at an angle generally conforming to the slope of the roof,
(iv) wherein the side walls and cap element support portion to define a longitudinally oriented channel, said channel being adapted to contain air-permeable vent material between the side walls.

14. An elongated support member as recited in claim 13 further comprising a plurality of parallel longitudinal grooves adapted as crease lines to define each skirt portions from its adjacent side wall, whereby the height of the side walls may be selected by bending the support member along chosen crease lines.

15. An elongated support member as recited in claims 13 or 14, wherein a vent opening in a side wall is formed with a flap disposed outwardly and upwardly from the bottom of the opening.

16. An elongated support member as recited in claim 15, wherein a vent opening in a side wall is formed with two flaps, one disposed outwardly and upwardly from the bottom of the opening and the other disposed outwardly and downwardly from the top of the opening.

17. A method of installing a ridge ventilation system on a sloped roof covered by tiles and which roof includes an open slot disposed along its ridge, said method comprising the steps of:

(a) installing tiles in rows running across the slope of the roof from the bottom edge of the roof toward the ridge, omitting the top row of tiles on each side of the ridge;
(b) forming an elongated support member from a generally rectangular flat sheet having plurality of grooves there on and perforations there through, said forming comprising the substeps of:
  (i) folding each lateral side of the sheet approximately 90° in the same direction, each fold being made along one of a pair of crease lines parallel to and equally spaced from a longitudinal center line of the sheet, to form an elongated member having a ridge tile anchoring portion running along its longitudinal axis and two longitudinally-oriented side walls, each wall connected to and depending vertically downward from the anchoring portion, wherein the side walls and anchoring portion define a longitudinally oriented channel,
  (ii) creating at least one vent opening through each side wall by bending outward from each side wall one or more flaps perforated in the sheet along crease lines provided there on,
  (iii) forming two longitudinally-oriented skirt portions, each skirt portion connected to and depending from one of the side walls, by bending each side wall outward at one of a plurality of parallel crease lines at an angle approximately equal to the pitch angle of the roof, said crease line being chosen from the plurality of crease lines according to the desired height of the side walls, (c) positioning an air-permeable vent material in and along said channel, substantially filling the channel between the side walls, (d) positioning the support member longitudinally over and straddling the slot along the roof ridge, (e) securing the support member in said position by inserting fasteners through the skirt portions into the roof, (f) installing the top row of tiles on each side of the ridge such that the tiles overlap the skirt portions, and (g) installing overlapping roof tiles on and along said anchoring portion and anchored to the support member by fasteners passing through the tiles into the anchoring portion, such that the ridge tiles are aligned longitudinally over the slot and extend over the top row of tiles on each side of the slot.

* * * * *